US005887303A

United States Patent [19]

Raith

[11] Patent Number: 5,887,303

[45] Date of Patent: Mar. 30, 1999

[54] BED WARMER APPARATUS

[76] Inventor: Edward J. Raith, 3395 Washington Rd., Parlin, N.J. 08859

[21] Appl. No.: 939,416

[22] Filed: Sep. 29, 1997

[51] Int. Cl.[6] ..... A47C 31/10

[52] U.S. Cl. ..... 5/658; 5/726; 5/941

[58] Field of Search ..... 5/421, 423, 284, 5/652.2, 726, 941; 219/217, 212; 392/350; 607/104; 62/259.3; 165/46

[56] References Cited

U.S. PATENT DOCUMENTS

| | | | |
|---|---|---|---|
| 2,259,712 | 10/1941 | Sweetland | 5/421 |
| 2,560,349 | 7/1951 | Inglis | 5/423 |
| 2,695,413 | 11/1954 | Maat | 5/421 |
| 3,230,556 | 1/1966 | Shippee | 5/423 |
| 3,444,922 | 5/1969 | Dingman | 5/423 |
| 3,451,505 | 6/1969 | Hulin | 219/117 |
| 3,713,182 | 1/1973 | McNeal | 5/421 |
| 4,602,486 | 7/1986 | Weinstein | 5/421 |
| 5,300,100 | 4/1994 | Hickle et al. | 5/423 |
| 5,557,230 | 9/1996 | Eldon | 219/211 |

*Primary Examiner*—Brian K. Green
*Assistant Examiner*—Frederick Conley

[57] ABSTRACT

A bed warmer apparatus including box-like housing member that has a pair of elongated side walls with a pair of short side walls therebetween. The pair of elongated side walls and the pair of short side walls are interconnected to a top wall. The top wall has a cylindrical coupler extending therefrom and defining an opening in the top wall. The housing member is sized for positioning around an air vent and receiving air therein to pass through the cylindrical coupler. Also, a fluted nozzle with a first end and a second end is provided. Lastly, an elongated flexible hose is included and has a first hose end coupled with the coupler and a second hose end coupled with the first end of the fluted nozzle.

1 Claim, 2 Drawing Sheets

BED WARMER APPARATUS

BACKGROUND OF THE INVENTION

1. Field of the Invention

The present invention relates to a bed warmer apparatus and more particularly pertains to providing an apparatus that will couple with wall and floor air vents to force air between a blancket and bed for warming the mattress.

2. Description of the Prior Art

The use of an air directing device is known in the prior art. More specifically, air directing devices heretofore devised and utilized for the purpose of controlling the flow of air are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 4,853,992 to Yu discloses an air cooled/heating seat cushion. U.S. Pat. No. 4,997,230 to Spitalnick discloses air conditioned cushion covers. U.S. Pat. No. Des. 297,158 to Marton discloses an air delivery duct. U.S. Pat. No. 4,240,401 to Chesnut and Parrigin discloses a fireplace heat exchanger. U.S. Pat. No. 5,181,328 to Bouverie discloses a wall-mounted hair dryer. Lastly, U.S. Pat. No. 4,250,800 to Brockmeyer discloses an outlet tube for air conditioning systems.

In this respect, the bed warmer apparatus according to the present invention substantially departs from the conventional concepts and designs of the prior art, and in so doing provides an apparatus primarily developed for the purpose of providing an apparatus that will couple with wall and floor air vents to force air between a blancket and bed for warming the mattress.

Therefore, it can be appreciated that there exists a continuing need for a new and improved bed warmer apparatus which can be used for providing an apparatus that will couple with wall and floor air vents to force air between a blancket and bed for warming the mattress. In this regard, the present invention substantially fulfills this need.

SUMMARY OF THE INVENTION

In view of the foregoing disadvantages inherent in the known types of air directing devices now present in the prior art, the present invention provides an improved bed warmer apparatus. As such, the general purpose of the present invention, which will be described subsequently in greater detail, is to provide a new and improved bed warmer apparatus which has all the advantages of the prior art and none of the disadvantages.

To attain this, the present invention essentially comprises a box-like housing member. The housing member has a pair of elongated side walls with a pair of short side walls therebetween. The pair of elongated side walls and the pair of short side walls areg interconnected to a top wall. Each side wall projecting outwardly from the top wall and forming a peripheral housing edge. The top wall has a cylindrical coupler extending therefrom and defining an opening in the top wall. The pair of elongated side walls each have an interior surface. Each interior surface has a non-skid strip attached. The housing member is sized for positioning around an air vent. Each of the non-skid strips of each elongated side wall gripping the air vent for coupling therewith and receiving air therein to pass through the cylindrical coupler. Included is a fluted nozzle. The fluted nozzle has a first end with a smaller interior diameter and a second end with a larger interior diameter. Lastly, an elongated flexible hose is provided. the elongated flexible hose has a first hose end and a second hose end. The first hose end is releasably coupled with the coupler of the housing member. The second hose end is releasably coupled with the first end of the fluted nozzle. The flexible hose member is in receipt of air passing through the cylindrical coupler for transporting air to the fluted nozzle for radial release under a blanket.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved bed warmer apparatus which has all the advantages of the prior art air directing devices and none of the disadvantages.

It is another object of the present invention to provide a new and improved bed warmer apparatus which may be easily and efficiently manufactured and marketed.

It is a further object of the present invention to provide a new and improved bed warmer apparatus which is of a durable and reliable construction.

An even further object of the present invention is to provide a new and improved bed warmer apparatus which is susceptible of a low cost of manufacture with regard to both materials and labor, and which accordingly is then susceptible of low prices of sale to the consuming public, thereby making such bed warmer apparatus economically available to the buying public.

Still yet another object of the present invention is to provide a new and improved bed warmer apparatus which provides in the apparatuses and methods of the prior art some of the advantages thereof, while simultaneously overcoming some of the disadvantages normally associated therewith.

Still another object of the present invention is to providing an apparatus that will couple with wall and floor air vents to force air between a blancket and bed for warming the mattress.

Lastly, it is an object of the present invention to provide a new and improved box-like housing member that has a pair of elongated side walls with a pair of short side walls therebetween. The pair of elongated side walls and the pair of short side walls are interconnected to a top wall. The top wall has a cylindrical coupler extending therefrom and defining an opening in the top wall. The housing member is sized for positioning around an air vent and receiving air therein to pass through the cylindrical coupler. Also, a fluted nozzle with a first end and a second end is provided. Lastly, an elongated flexible hose is included and has a first hose end coupled with the coupler and a second hose end coupled with the first end of the fluted nozzle.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
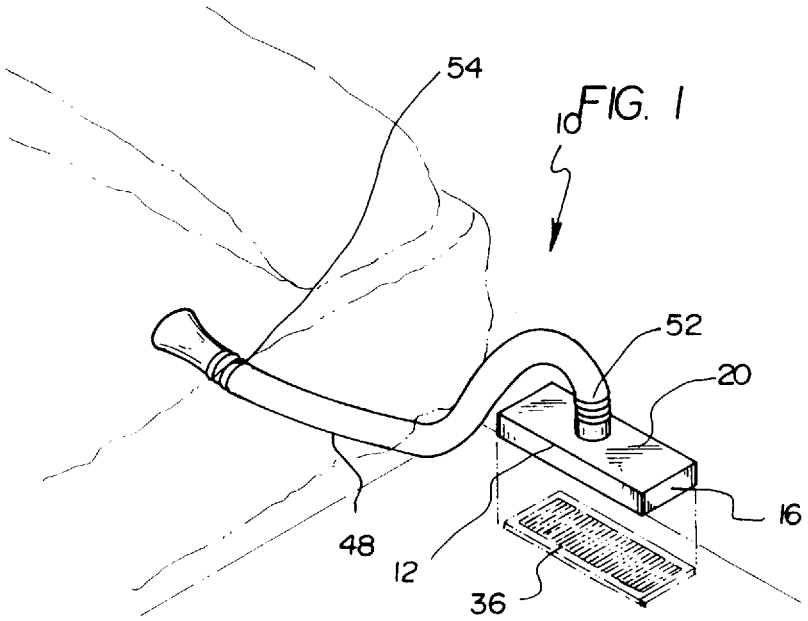
FIG. 1 is a perspective illustration of the preferred embodiment of the bed warmer apparatus constructed in accordance with the principles of the present invention.

With reference now to the drawings, and in particular to FIG. 1 thereof, a new and improved bed warmer apparatus embodying the principles and concepts of the present invention and generally designated by the reference numeral 10 will be described.

The present invention, the new and improved bed warmer apparatus, is comprised of a plurality of components. Such components in their broadest context include a housing, a nozzle and a hose. Such components are individually configured and correlated with respect to each other so as to attain the desired objective.

More specifically, it will be noted that a box-like housing member 12 is provided. The housing member has a pair of elongated side walls 14 with a pair of short side walls 16. The housing member is formed of a rigid plastic. The pair of elongated side walls and the pair of short side walls are interconnected to a top wall 20, as shown in FIG. 1. Each side wall projects outwardly from the top wall and forms a peripheral housing edge 22.

Figure 3:
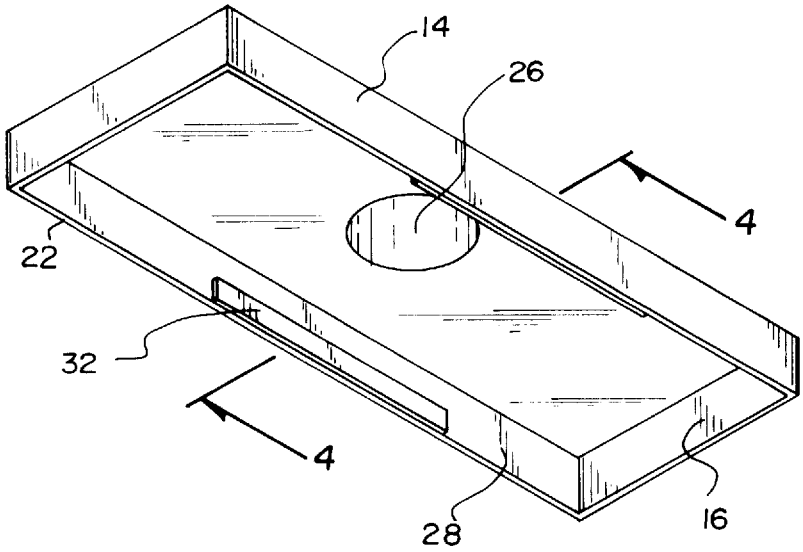
FIG. 3 is isometric bottom view of the housing of the present invention.
Figure 4:
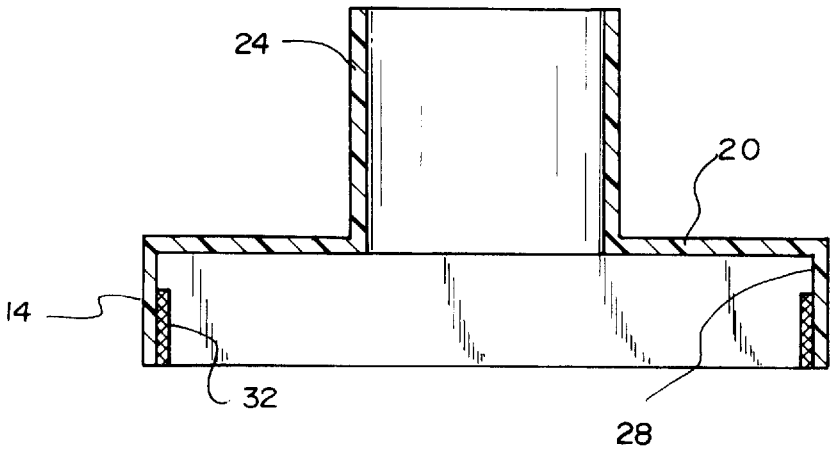
FIG. 4 is a cross-sectional view of the housing of the present invention.

Also, the top wall has a cylindrical coupler 24, as depicted in FIG. 4. The cylindrical coupler extends therefrom and defines an opening 26 in the top wall. FIG. 3 shows the opening passing through the top wall. The pair of elongated side walls each have an interior surface 28. Each interior surface has a non-skid strip 32 attached. The non-skid strips of each short side wall is formed of rubber.

Additionally, the housing member 12 is sized for positioning around an air vent 36. Each of the non-skid strips of each elongated side wall grip the air vent. When the non-skid strips grip the air vent, the peripheral housing edge 22 rest on either the floor or wall and the housing is coupled therearound. The receiving air therein passes into the housing and through the cylindrical coupler.

Figure 2:
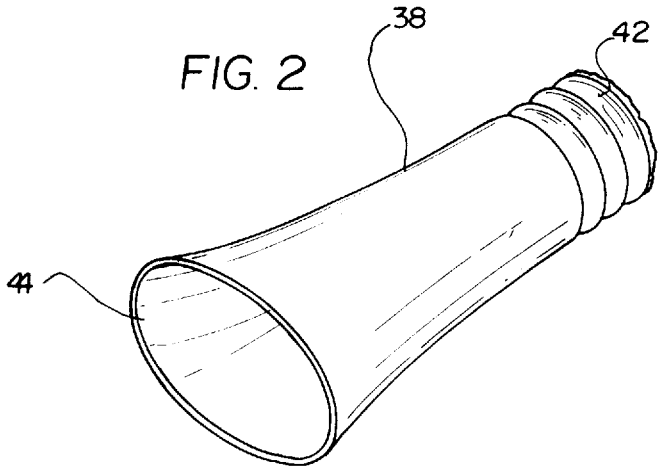
FIG. 2 is an isometric view of the fluted nozzle of the present invention.

Included is a fluted nozzle 38. FIG. 2 shows the fluted nozzle with a first end 42 with a smaller interior diameter and a second end 44 with a larger interior diameter.

Lastly an elongated flexible hose 48 is provided. The elongated flexible hose has a first hose end 52 and a second hose end 54. The first hose end is releasably coupled with the coupler 24 of the housing member. The second hose end is releasably coupled with the first end 42 of the fluted nozzle. The flexible hose member is in receipt of air passing through the cylindrical coupler for transporting air to the fluted nozzle for radial release under a blanket.

The present invention bed warmer apparatus is an easy to use apparatus that will pre warm your bed on cold evenings. The present invention has a housing member and a nozzle. A flexible hose connects the housing member and the nozzle so as to allow air to pass from the air vent to the space between the blanket and mattress. Because the nozzle is fluted the air is distributed in a radial fashion and quickly warms the entire bead.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved bed warmer apparatus used in combination with an existing air vent, the apparatus comprising, in combination:

a box-like housing member having a pair of elongated side walls with a pair of short side walls therebetween, the pair of elongated side walls and the pair of short side walls being interconnected to a top wall, each side wall projecting outwardly from the top wall and forming a peripheral housing edge, the top wall having a cylindrical coupler extending therefrom and defining an opening in the top wall, the pair of elongated side walls each having an interior surface, each interior surface having a non-skid strip attached thereto, the housing member having an open lower end dimensioned for positioning around the existing air vent, each of the non-skid strips of each elongated side wall gripping the air vent for coupling therewith and receiving air therein to pass through the cylindrical coupler;

a flared nozzle having a first end with a smaller interior diameter and a second end with a larger interior diameter; and an elongated flexible hose having a first hose end and a second hose end, the first hose end being releasably coupled with the coupler of the housing member, the second hose end being releasably coupled with the first end of the flared nozzle, the flexible hose member being in receipt of air passing through the cylindrical coupler for transporting air from the air vent to the flared nozzle for radial release under a blanket.

* * * * *